US005652939A

United States Patent [19]

Verlinden et al.

[11] Patent Number: 5,652,939

[45] Date of Patent: Jul. 29, 1997

[54] APPARATUS FOR THE WET PROCESSING OF PHOTOGRAPHIC SHEET MATERIAL

[75] Inventors: Bartholomeus Verlinden, Tongeren; Patrick Van den Bergen, Berchem, both of Belgium

[73] Assignee: Agfa-Gevaert N.V., Mortsel, Belgium

[21] Appl. No.: 643,824

[22] Filed: May 7, 1996

[30] Foreign Application Priority Data

May 20, 1995 [EP] European Pat. Off. ..... 95201327

[51] Int. Cl.[6] ..... G03D 3/08

[52] U.S. Cl. ..... 396/624; 396/612; 396/630; 396/636

[58] Field of Search ..... 354/319, 320, 354/322, 324, 331; 396/612, 620, 622, 624, 626, 630, 636

[56] References Cited

U.S. PATENT DOCUMENTS 2,918,069 12/1959 Brown et al. ..... 354/219
4,166,689 9/1979 Schausberger et al. ..... 354/322
4,987,438 1/1991 Goto et al. ..... 354/324
5,108,878 4/1992 Nakamura ..... 354/322
5,479,232 12/1995 Van Den Bergen et al. ..... 354/320

*Primary Examiner*—A. A. Mathews
*Attorney, Agent, or Firm*—Brumbaugh, Graves, Donohue & Raymond

[57] ABSTRACT

A wet processor comprises a plurality of cells (12, 12', 12") mounted one above the other in a stack to define a substantially vertical sheet material path (20) through the apparatus. Each cell comprises a housing within which is mounted rotatable roller (28) biased towards a reaction surface (31) to define a roller nip (36) there-between through which the sheet material path extends and associated sealing means (38, 39) serving to provide a gas- and liquid-tight seal between roller (28) and reaction surface (31) on the one hand and a wall (14) of the housing on the other. The roller (28) is a drive roller. Alternatively or additionally means (19, 21) are provided for connecting each cell to adjacent cells in the stack in a closed manner. By this simple construction, treatment liquid in one cell is not contaminated by contents of the adjacent cells. Furthermore, consumption of treatment liquids is reduced by reducing the evaporation, oxidation and carbonization thereof.

14 Claims, 5 Drawing Sheets

APPARATUS FOR THE WET PROCESSING OF PHOTOGRAPHIC SHEET MATERIAL

DESCRIPTION

1. Field of the Invention

The present invention relates to an apparatus for the processing of photographic sheet material, such as X-ray film, pre-sensitised plates, graphic art film and paper, and offset plates. More particularly the invention relates to improvements in apparatus in which photographic material is transported through one or more treatment units.

2. Background of the Invention

As a rule, a processing apparatus for photographic sheet material comprises several vessels each of which contains a treatment liquid, such as a developer, a fixer and a rinse liquid. As used herein, the term sheet material includes not only photographic material in the form of cut sheets, but also in the form of a web unwound from a roll. The sheet material to be processed is transported through these vessels in turn, by transport means such as one or more pairs of drive rollers, and thereafter optionally to a drying unit. The time spent by the sheet material in each vessel is determined by the transport speed and the dimensions of the vessel in the sheet feed path direction.

In a conventional processing apparatus the sheet material is transported along a generally horizontal feed path, the sheet material passing from one vessel to another usually via a circuitous feed path passing under the surface of each treatment liquid and over dividing walls between the vessels. However, processing machines having a substantially vertical orientation have also been proposed, in which a plurality of vessels are mounted one above the other, each vessel having an opening at the top acting as a sheet material inlet and an opening at the bottom acting as a sheet material outlet or vice versa. In the present context, the term "substantially vertical" is intended to mean that the sheet material moves along a path from the inlet to the outlet which is either exactly vertical, or which has a vertical component greater than any horizontal component. The use of a vertical orientation for the apparatus leads to a number of advantages. In particular the apparatus occupies only a fraction of the floor space which is occupied by a conventional horizontal arrangement. Furthermore, the sheet transport path in a vertically oriented apparatus may be substantially straight, in contrast to the circuitous feed path which is usual in a horizontally oriented apparatus. The straight path is independent of the stiffness of the sheet material and reduces the risk of scratching compared with a horizontally oriented apparatus.

In a vertically oriented apparatus, it is important to avoid, or at least minimise leakage of treatment liquid from one vessel to another and carry-over as the sheet material passes through the apparatus. U.S. Pat. No. 4,166,689 (Schausberger et al. assigned to Agfa-Gevaert A G) describes such an apparatus in which liquid escapes from the lower opening and is intercepted by the tank of a sealing device with two squeegees located in the tank above a horizontal passage in line with the lower opening. One or more pairs of drive rollers in the vessel close the lower opening and also serve to transport the sheet material along a vertical path which extends between the openings of the vessel.

It is desirable that the treatment liquid in one vessel is not contaminated by contents of the adjacent vessels, that is neither by the treatment liquid of the next higher vessel nor by vapours escaping from the next lower vessel.

Furthermore, in order to reduce consumption of treatment liquids, it is desirable to reduce the evaporation, oxidation and carbonization thereof.

SUMMARY OF THE INVENTION

We have discovered that contamination and evaporation, oxidation and carbonization can both be reduced in a simple manner by a particular construction of the apparatus.

The invention provides an apparatus for the processing of photographic sheet material comprising a plurality of cells mounted one above the other in a stack to define a substantially vertical sheet material path through the apparatus, each cell comprising a housing within which is mounted a rotatable roller biased towards a reaction surface to define a roller nip there-between through which the sheet material path extends and associated sealing means serving to provide a gas- and liquid-tight seal between the roller and reaction surface on the one hand and a wall of the housing on the other. According to a first aspect, invention is characterised by means for connecting each cell to adjacent cells in the stack in a closed manner. According to a second aspect, the invention is characterised in that the roller is a drive roller.

By providing a gas- and liquid-tight seal between the roller and reaction surface on the one hand and a wall of the housing on the other, treatment liquid in one vessel is not contaminated by the contents of adjacent vessels, while constituting the roller as a drive roller enables the cell to be constituted in a particularly simple manner, in contrast to the apparatus described in U.S. Pat. No. 4,166,689, where the rollers with which sealing means are associated to provide a seal to the housing are freely rotatable squeegee rollers, necessitating the provision of further roller pairs to advance the sheet material through the apparatus.

In preferred embodiments of the present invention, there are provided means for connecting each cell to adjacent cells in the stack in a closed manner. By the term "closed manner" in this specification is meant that each cell is so connected to adjacent cells that no cell is open to the environment. By connecting cells together in this manner, contrary to the apparatus described in U.S. Pat. No. 4,166,689, the evaporation, oxidation and carbonization of treatment liquids can be significantly reduced.

The reaction surface towards which the roller is biased to define the nip will usually be the surface of another roller, or for the reaction surface to be in the form of a belt or a fixed surface with a low friction coefficient. Where this general description refers to the use of two rollers, it is to be understood that the second roller may be replaced by any other reaction surface, such as those referred to above.

The housing wall of each cell may comprise an upper housing wall part and a lower housing wall part, the upper housing wall part being so shaped in relation to the lower housing wall part of the next higher cell as to provide a substantially closed connection between adjacent cells. For example, the upper and lower housing wall parts may be provided with flanges, means being provided to secure the flange of the upper housing wall part with the flange of the lower housing wall part of the next higher cell thereby to provide the substantially closed connection.

The rollers and associated sealing means of the top-most cell of the stack serve to provide a gas-tight cover for the apparatus.

At least one cell of the stack is preferably in the form of a vessel, suitable for containing treatment liquid, the rollers and sealing means serving to retain treatment liquid in the vessel. The top-most cell will not normally be a liquid-containing vessel, serving simply as the gas-tight cover for the apparatus.

A lower part of the housing wall of each vessel may be so shaped as to define a leakage tray so positioned that any treatment liquid which passes, for example, through the nip drips into the leakage tray, for collection and recirculation as desired.

Each cell may be of modular construction and provided with means to enable the cell to be mounted directly above or below an identical or similar other cell. Alternatively, the apparatus may take an integral or semi-integral form in which the means for connecting each cell to adjacent cells in the stack in a closed manner is constituted by a common housing wall of the apparatus. By the term "semi-integral form" we intend to include an apparatus which is divided by a substantially vertical plane passing through all the vessels in the apparatus, particularly the plane of the sheet material path, enabling the apparatus to be opened-up for servicing purposes, in particular to enable easy access to the rollers.

By the use of a vertical configuration, the cross-section of the cell can be low, such as less than 3 times the roller diameter. The volume of the cell can therefore be low. Indeed, for a given sheet material path length, the volume of one vessel of a vertical processing apparatus can be many times smaller than the volume of an equivalent treatment bath in a horizontal processing apparatus. This has advantages in terms of the volume of treatment liquids used and the efficiency of their interaction with the sheet material.

A basic cell of the apparatus according to the invention contains merely the rollers and associated sealing means.

Nevertheless, one or more of the cells of the apparatus may include additional features if desired. Cleaning means may be provided for acting upon the rollers to remove debris therefrom, as described in European patent application EP 93202862 (Agfa-Gevaert N V), filed 11 Oct., 1993. Additional rollers, such as a roller pair or staggered rollers may be provided for transporting the sheet material through the apparatus, and these rollers will normally be driven rollers. Additional roller pairs may be provided for breaking the laminar fluid at the surface of the sheet material as it passes through the apparatus, and these rollers may be driven rollers or freely rotating rollers. Even when additional roller pairs are present, the rollers to which the ($\phi$/L) criterium applies and their associated sealing means will usually constitute the lower roller pair, serving to close the lower opening of the vessel. Spray means may be provided for applying treatment liquid to the sheet material. Guide means may be included for guiding the passage of the sheet material through the apparatus. Heating means may be provided in one or more cells so that the cell becomes a sheet material drying unit, rather than a wet treatment unit.

While liquid pumping, heating, cooling and filtering facilities will normally be provided outside the cells, it is possible for some elements of these features to be included in the cells themselves. Any combination of these additional features is also possible.

In one embodiment of the invention, one or more of the vessels includes at least one passage through the housing wall thereof to constitute a treatment liquid inlet to and/or outlet from the vessel.

One or more cells may not contain processing liquid, these cells providing, for example, a dead space where diffusion reactions can occur on the sheet material as it passes there-through.

A convenient arrangement for the processing of photographic sheet material may comprise a first vertical processing apparatus according to the invention coupled to a horizontal processing apparatus in which the sheet material passes along a substantially horizontal path. The horizontal apparatus may in turn be coupled to a second vertical processing apparatus according to the invention. For example, the first vertical processing apparatus is adapted for the development of images on the photographic sheet material and will therefore include one or more vessels containing developer solution, the horizontal processing apparatus is adapted for the fixing of developed images on the photographic sheet material and will therefore include one or more vessels containing fixing solution, and the second vertical processing apparatus is adapted for the cascade washing and optionally drying of the photographic sheet material.

It is desirable that the gas- and liquid-tight seal between the rollers and the housing wall is achieved in a simple and reliable manner. We therefore prefer a construction in which the rollers are axially offset relative to each other and each roller is in sealing contact along its length, at least between the limits of the nip, with a stationary sealing member.

The sealing member preferably includes a portion which extends longitudinally along the surface of the associated roller. This longitudinal part of the sealing member may extend in a straight line parallel to the associated roller axis and preferably contacts the surface of the associated roller at a location which is between 45° and 225°, most preferably between 80° and 100° from the centre of the nip, on the fluid side.

The benefit of this arrangement is that the sealing members do not influence the bias forces between the rollers, or only influence these forces to a limited extent.

In a preferred construction of the apparatus according to the invention, the sealing member is carried on a sealing support, secured to the housing wall of the cell.

By arranging for the rollers to be axially offset with respect to each other, it is possible that the sealing member may include a portion which extends circumferentially around the surface of its associated roller. To ensure a good seal at this point, the sealing support may be in contact with the end face of the opposite roller. Means, such as sinus springs incorporated in the roller mountings, may be provided for pulling each of the rollers against a respective end plate of the sealing support with a force of from 2 to 500 g/cm of contact between the end plate and the end face of the roller measured at the surface of the roller. In order to reduce the torque required to rotate the rollers, the ratio of the maximum roller diameter to the length of the nip is preferably greater than 0.012.

The sealing member may be in a unitary or composite form which exerts a spring force of between 2 and 500 g/cm of roller, perpendicular to the roller surface. The spring loading may be derived from the geometry of a unitary sealing member, from a separate spring incorporated in a composite sealing member or simply from the compression of the elastomeric material covering the roller. The sealing member material which is in contact with the associated roller surface preferably has a coefficient of friction (as measured against stainless steel) of from 0.05 to 0.3, preferably from 0.09 to 0.2. The sealing member material in contact with the associated roller surface may comprise a polymer material such as PTFE (poly tetra fluoro ethylene), POM (polyoxymethylene), HDPE (high density polyethylene), UHMPE (ultra high molecular weight polyethylene), polyurethane, PA (polyamide), PBT (polybutyl terephthalate) and mixtures and composites thereof. We prefer to use a PTFE profile backed with a stainless steel spring.

In a further preferred embodiment, the rollers are substantially equal in length. One or both rollers may constitute drive rollers for driving the sheet material along the sheet material path. Alternatively, the second roller may be freely rotating.

Typical rollers have a core provided with a covering of elastomeric material, although it is possible for the roller to be elastomeric throughout its cross-section. As the sheet material leaves a given liquid treatment vessel it is necessary to remove any liquid carried on the sheet material as efficiently as possible, to prevent carry-over of liquid into a next treatment cell and to reduce edge effects which arise from non-homogeneous chemistry on the sheet material after squeegeeing. To do this job properly, the rollers must exert a sufficient and homogeneous pressure over the whole width of the sheet material. Also, to reduce edge effects, it is desirable that the opposite roller surfaces are in contact with each other beyond the edges of the sheet material. To put this problem in context, rollers used in conventional processing apparatus for example have a length of 400 mm and a diameter of from 24 to 30 mm. The sheet material typically has a width of from a few millimeters up to 2 m and a thickness of 0.05 mm to 0.5 mm. In view of the nature of elastomeric material, it is in fact impossible to totally eliminate any gap between the roller surfaces at the edges of the sheet material as it passes through the nip. It is desirable that the roller surfaces be in contact with each other within as short a distance as possible from the edges of the sheet material i.e. that the size of the leak zone should be minimised. It is important however that the force between the rollers is sufficient to prevent leakage when no sheet material is passing through. However, the force must not be so high as to risk physical damage to the sheet material as it passes through the nip.

The objective of a minimum leak zone referred to above can be achieved if the ratio of the diameter of the roller to its length is above a critical limit.

According to a preferred embodiment of the invention therefore, at least one of the rollers, and preferably each roller, comprises a rigid core carrying a covering of elastomeric material, the ratio ($\phi/L$) of the maximum diameter ($\phi$) of the elastomeric material covering to the length (L) thereof being at least 0.012, most preferably between 0.03 and 0.06. Where the reaction surface towards which the roller is biased to define the nip is the surface of another roller, it is preferred that the roller requirements referred to above apply to this, second, roller also. Indeed, it will be usual for the two rollers to be identical, although it is possible that the diameters ($\phi$), and therefore the ratios ($\phi/L$), of the two rollers need not be identical. It is also possible that the reaction surface may be formed by the surface of a second roller which does not conform to the above requirements, such as for example, a roller having no elastomeric covering, or for the reaction surface to be in the form of a belt.

The elastomeric material covering preferably has a thickness of between 1 mm and 30 mm. The elastomeric material may be selected from ethylene/propylene/diene terpolymers (EPDM), silicone rubber, polyurethane, thermoplastic rubber such as Santoprene (Trade Mark for polypropylene/EPDM rubber), styrene-butyl rubber and nitrilebutyl rubber. The hardness of the elastomeric material may be between 15 Shore (A) and 90 Shore (A), as measured on the roller surface. In one embodiment of the invention, the diameter ($\phi$) of the elastomeric material covering is constant along the length of the roller. Alternatively the roller may have a radial dimension profile which varies along the length thereof. In the latter case, the diameter ($\phi$) in the expression $\phi/L$ is the maximum diameter. In a preferred embodiment, such a roller comprises a non-deformable core, the thickness of the elastomeric material covering varying along the length thereof. Alternatively or additionally, the diameter of the core varies along the length thereof.

Ideally, the radial dimension profile of such a roller is such in relation to the force applied by the roller to sheet material passing through the nip as to be substantially even over the width thereof.

The radial dimension of the roller ideally decreases towards the ends thereof i.e. a convex profile, especially a parabolic profile.

Preferably, the core has a flexural E-modulus of between 50 GPa and 300 GPa. Suitable materials for the rigid core include metals, such as stainless steel, non-ferrous alloys, titanium, aluminium or a composite thereof.

In one embodiment of the invention, the core is hollow. Alternatively the core may be solid.

The rollers may be biased together by a variety of methods. The rollers may be biased together for example by making use of the intrinsic elasticity of the elastomeric material, by the use of fixed roller bearings. Alternatively, use may be made of resilient means such as springs which act on the ends of the roller shafts. The springs may be replaced by alternative equivalent compression means, such as e.g. a pneumatic or a hydraulic cylinder.

PREFERRED EMBODIMENTS OF THE INVENTION

The invention will now be further described, purely by way of example, by reference to the accompanying drawings in which.

Although only one specific embodiment of a treatment vessel according to the invention is shown in FIGS. 1 to 6, the invention is not restricted thereto. The apparatus for the wet processing of photographic sheet material such as X-ray film as shown in the Figures comprises a plurality of treatment cells 12, 12', 12" mounted one above another. These cells may be arranged to provide a sequence of steps in the processing of sheet photographic material, such as developing, fixing, rinsing and drying. The cells may be of a modular structure as shown or may be part of an integral apparatus.

Figure 1:
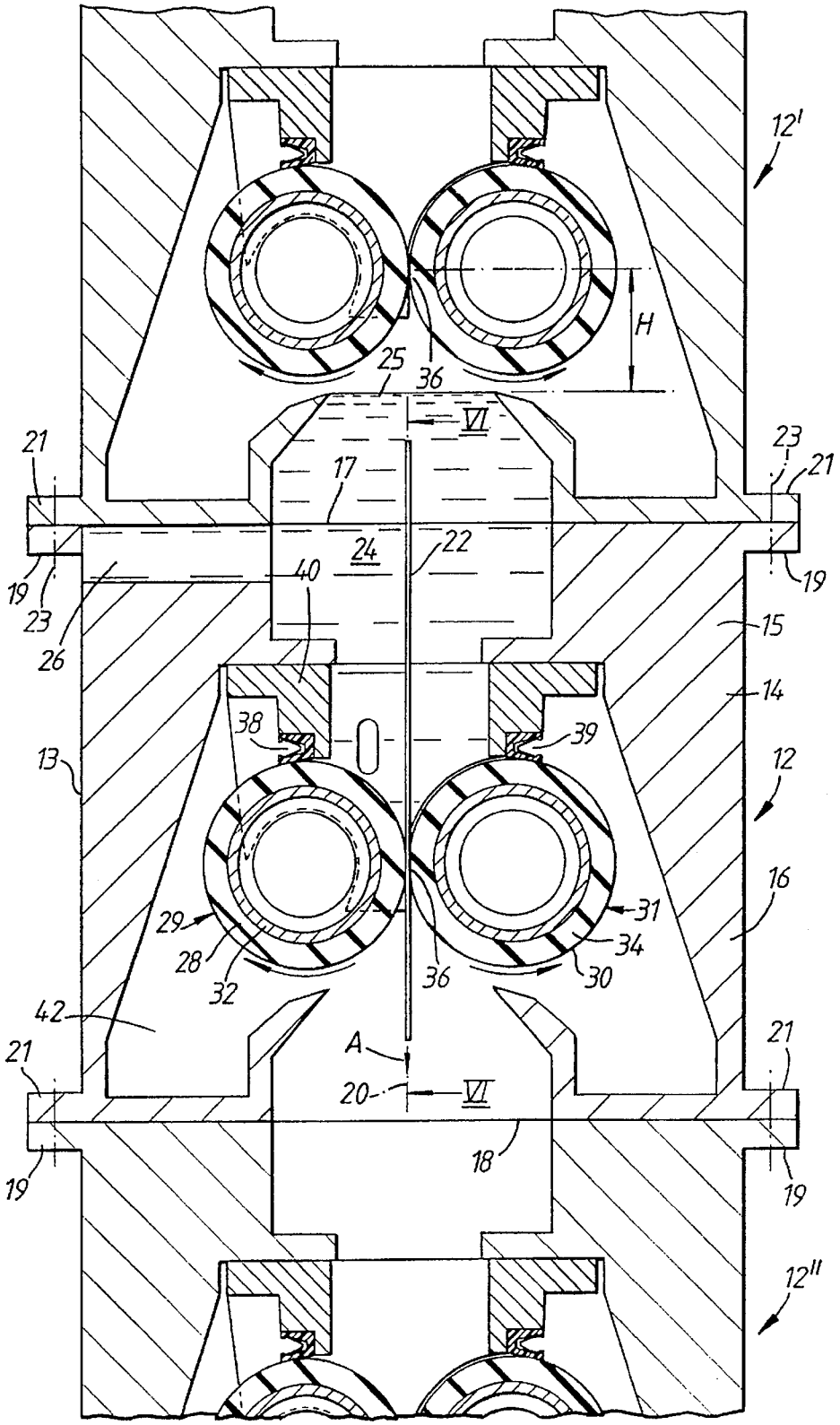
FIG. 1 is a cross-sectional view of one cell of a vertical processing apparatus according to the invention, with adjacent cells being partly shown.

FIG. 1 shows that the cell 12 is in the form of a vessel 13 which is of generally rectangular cross-section comprising a housing defined by a housing wall 14 so shaped as to provide an upper part 15 having an upper opening 17 and a lower part 16 having a lower opening 18. The upper opening 17 constitutes a sheet material inlet and the lower opening 18 constitutes a sheet material outlet. The inlet and outlet define there-between a substantially vertical sheet material path 20 through the vessel 13, the sheet material 22 moving in a downwards direction as indicated by the arrow A. Mounted within the cell 12 are a pair of rotatable drive rollers 28, 30. The vessel 13 contains treatment liquid 24, a passage 26 through the housing wall 14 being provided as an inlet for the treatment liquid 24. The distance H between the surface 25 of the liquid 24 and the nip of the rollers of the next upper cell 12' is as low as possible.

Each roller 28, 30 is of the squeegee type comprising a stainless steel hollow core 32 carrying an elastomeric covering 34. The core 32 is in cylindrical form having constant internal and external diameters along the length thereof. The rollers 28, 30 are biased towards each other with a force sufficient to effect a liquid tight seal but without causing damage to the photographic sheet material 22 as it passes there-between. The line of contact between the roller surfaces 29 and 31 defines a nip 36. The sheet material preferably has a width which is at least 10 mm smaller than the length of the nip, so as to enable a spacing of at least 5 mm between the edges of the sheet and the adjacent limit of the nip 36, thereby to minimise leakage. The rollers 28, 30 are coupled to drive means (not shown) so as to constitute drive rollers for driving the sheet material 22 along the sheet material path 20.

Each roller 28, 30 is in sealing contact along its length, with a respective stationary sealing member 38, 39 carried on a sealing support 40, which in turn is secured to the housing wall 14 of the vessel 13, the sealing members 38, 39 serving to provide a gas- and liquid-tight seal between the rollers 28, 30 on the one hand and the housing wall 14 on the other. The treatment liquid 24 is therefore retained in the vessel 13 by the rollers 28, 30 and the sealing members 38, 39.

The sealing members 38, 39 are formed of PTFE and have a composite structure as shown more clearly in FIG. 2, referred to below. The sealing members 38, 39 are secured to the sealing support 40 by a suitable, water- and chemical-resistant adhesive, such as a silicone adhesive.

The upper and lower housing wall parts 15, 16 are provided with flanges 19, 21 respectively provided with bolts indicated by broken lines 23 to enable the cell 12 to be mounted directly above or below an identical or similar other cell 12', 12", as partly indicated FIG. 1. In the illustrated embodiment, the adjacent cells 12' and 12" are non-liquid containing cells. The upper housing wall part 15 is so shaped in relation to the lower housing wall part 16 as to provide a substantially closed connection between adjacent cells. Thus, treatment liquid from vessel 13 is prevented from falling into the lower cell 12" by the rollers 28, 30 and sealing members 38, 39, while vapours from the lower cell 12" are prevented from entering the vessel 13 or escaping into the environment. This construction has the advantage that the treatment liquid in the vessel 13 is not contaminated by contents of the adjacent cells and that by virtue of the treatment liquids being in a closed system evaporation, oxidation and carbonization thereof and any other undesirable exchange between the treating liquid and the environment are significantly reduced.

The lower part 16 of the housing wall 14 is so shaped as to define a leakage tray 42. Any treatment liquid which may pass through the roller nip 36, in particular as the sheet material 22 passes therethrough, drips from the rollers and falls into the leakage tray 42 from where it may be recovered and recirculated as desired.

Figure 2:
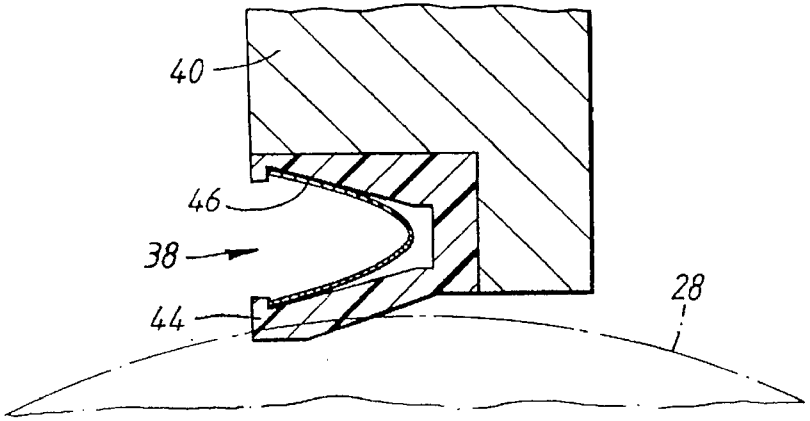
FIG. 2 is a cross-sectional view of a sealing member forming part of the cell shown in FIG. 1, together with part of adjacent components.

As can be seen more clearly in FIG. 2, the sealing member 38 is of composite structure having an open profile 44 formed of PTFE, within which profile is incorporated a stainless steel spring 46. FIG. 2 also shows how the sealing member 38 is retained in the sealing support 40. In FIG. 2, the sealing member 38 is shown in its relaxed position, the outline of the roller 28 also being shown in this Figure. The two sealing members 38, 39 are identical in the illustrated embodiment.

Figure 3:
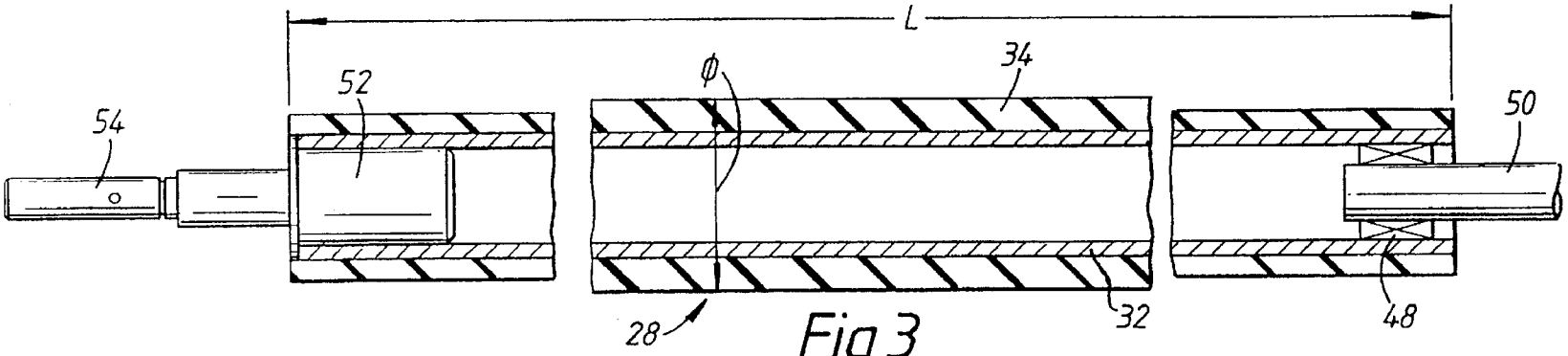
FIG. 3 is a longitudinal cross-sectional view showing the detail of the construction of one roller used in the cell shown in FIG. 1.

The construction of roller 28 is shown in more detail in FIG. 3. The construction of roller 30 is similar. The roller 28 comprises a core 32 of stainless steel, having a constant outside diameter of 25 mm and an internal diameter of 19 mm. The stainless steel core 32 has a flexural E-modulus of 210 GPa. The core 32 is provided with a covering 34 of EPDM rubber, an elastomer having a hardness of 30 Shore (A). The core 32 has a thickness varying from 7 mm and the roller ends to 7.5 mm at the roller centre. The roller 28 has a length of 750 mm and a maximum diameter of 40 mm. The maximum $\phi/L$ ratio is therefore approximately 0.053.

FIG. 3 also shows two possible methods of mounting the roller, one at each end thereof. In practice, it will be usual to use one method only at both ends. At the right hand end of FIG. 3, an internal bearing 48 is provided in which a fixed shaft 50 locates, the shaft being fixedly carried in the apparatus. At the left-hand end of FIG. 3, a spindle 52 is fixedly retained in the hollow core 32 and has a spindle end 54 which extends into a bearing (not shown) in the apparatus, or carries a drive wheel thereon. This construction is suitable for that end of the roller which transmits the drive.

Figure 5:
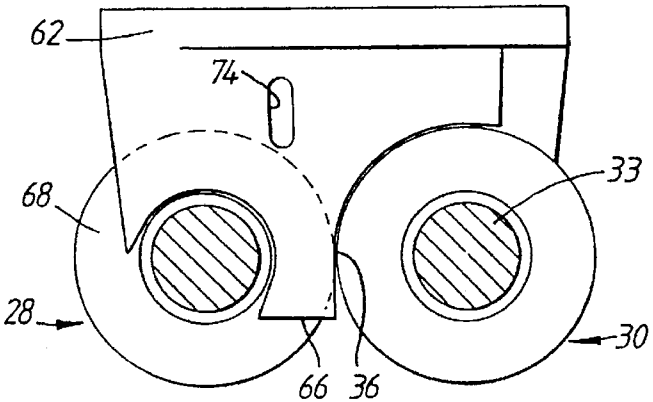
FIG. 5 is an end view of the sealing support and rollers taken in the direction V—V in FIG. 4.
Figure 4:
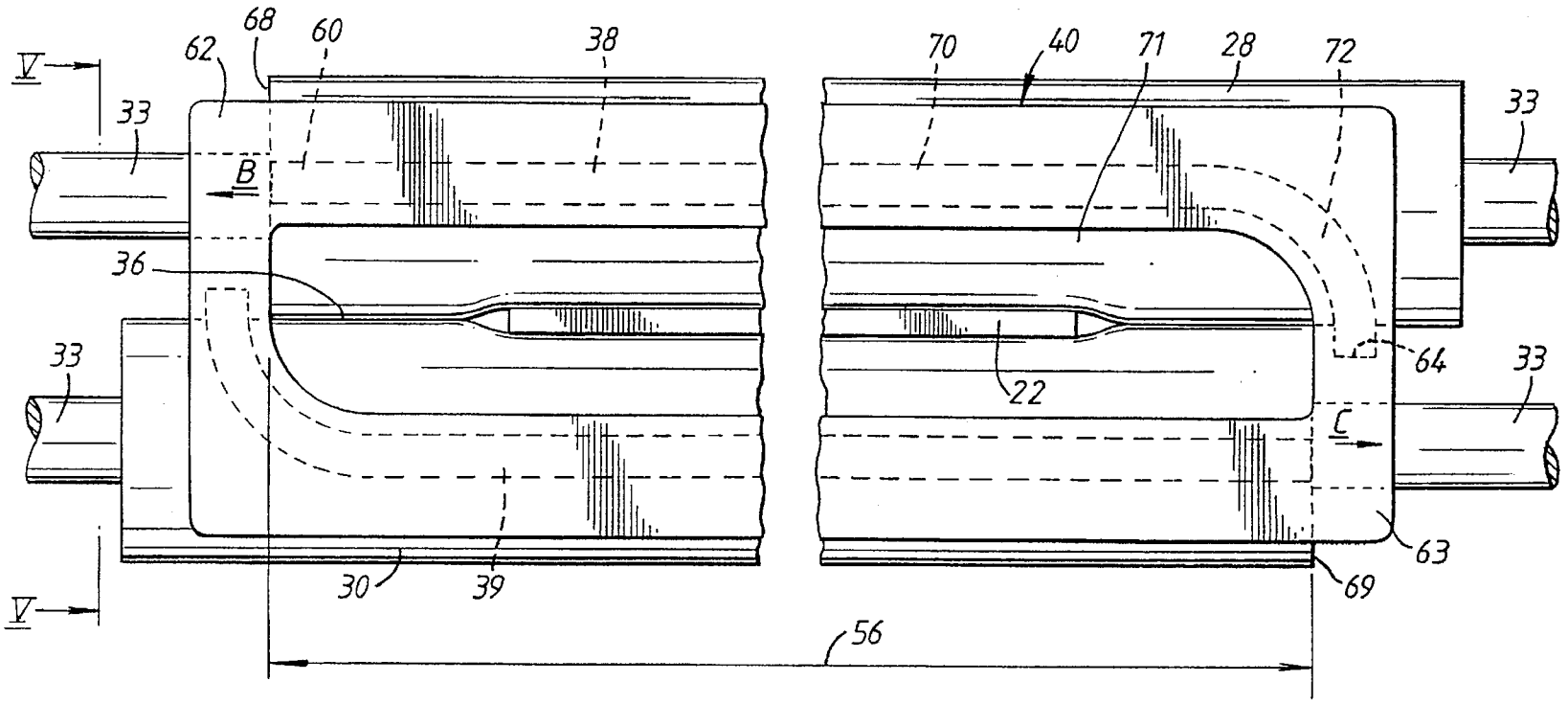
FIG. 4 is a view from above showing the sealing support and rollers of the cell shown in FIG. 1.
Figure 6:
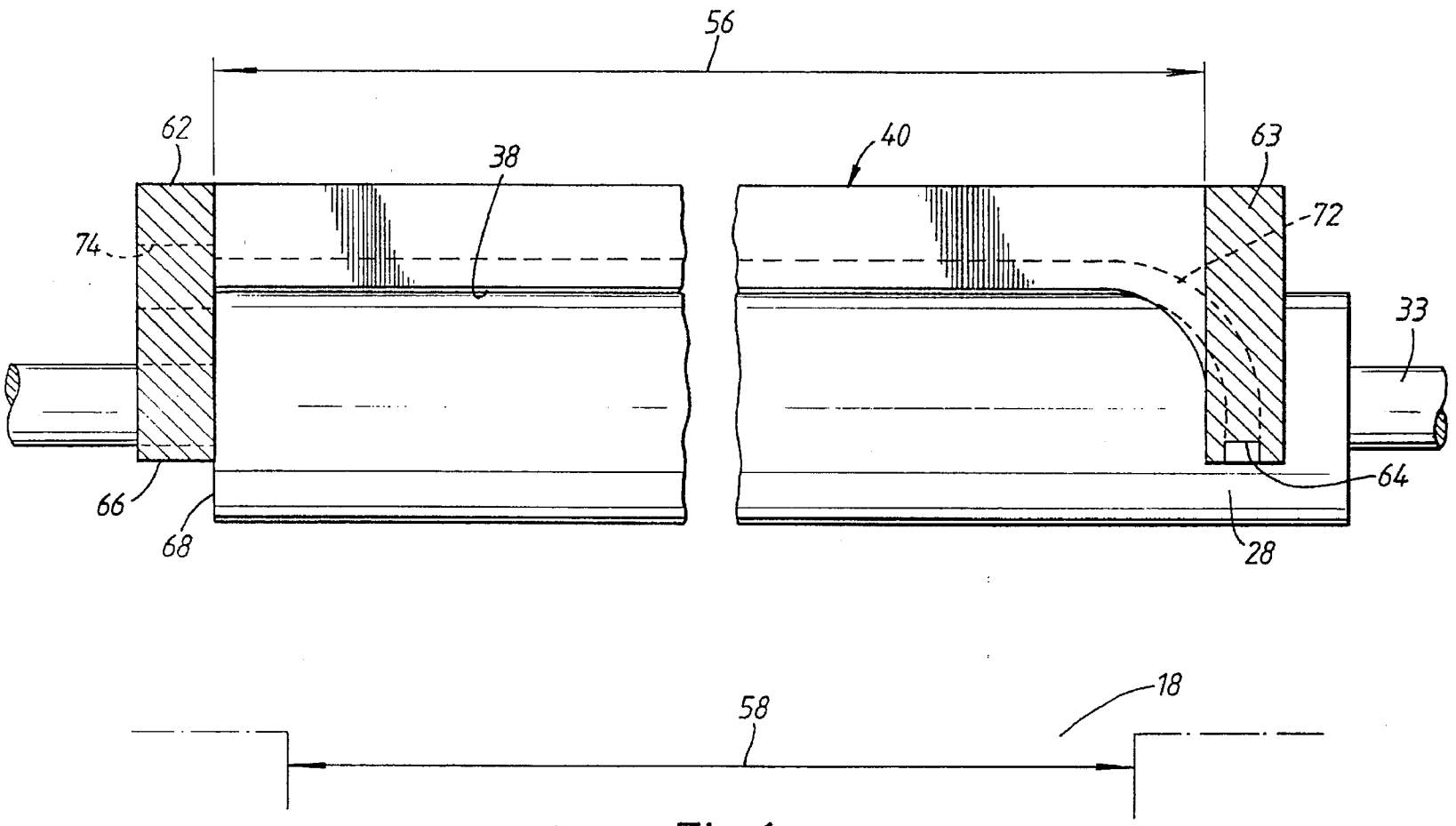
FIG. 6 is a side view of part of the sealing support and one roller taken in the direction VI—VI in FIG. 1.

As indicated in FIGS. 4, 5 and 6, the rollers 28, 30 are axially offset relative to each other. The nip 36 has a length which extends between limits 56 beyond the limits 58 of the lower opening 18. The rollers 28, 30 are substantially equal in length.

The end plate 62 of the sealing support 40 is so shaped as to have a lower edge 66 which follows a circumferential line around the shaft 33 of the first roller 28 and a circumferential line around the second roller 30 to enable the end plate to be in face-to-face contact with the end face 68 of the first roller 28. At its lowest point, the edge 66 is below the level of the nip 36. The circumferential distance over which the end plate 62 is in contact with the end face 68 of the first roller 28 is larger than the circumferential distance between the nip 36 and the sealing member 38.

One end 60 of the sealing member 38 is pulled against an end plate 62. To achieve this, the roller 28 is pulled in the direction of the arrow B by sinus springs, not shown, incorporated in the roller mountings. A suitable pulling force is from 2 to 500 g/cm of contact between the end plate 62 of the sealing support 40 and the end face 68 of the roller 28 measured at the surface of the roller. The sealing member 38 includes a portion 70 which extends longitudinally in a straight line away from the end plate 62 along the surface 29 of the first roller 28. The sealing member 38 contacts the surface 29 of the first roller 28 at a location which is about 90° from the centre of the nip 36 on the fluid side, that is from the plane joining the axes of rotation of the rollers 28, 30. By arranging for the rollers 28, 30 to be axially offset with respect to each other, it is made possible for the sealing member 38 to include a portion 72, which extends circumferentially around the surface of the first roller 28. This circumferentially extending portion 72 of the sealing member 38 completes a sealing path to the opposite end plate 63, where the end of the sealing member 38 is retained in a blind aperture 64 formed in the end plate 63, while the end plate 63 bears against the end face 69 of the second roller 30. The second sealing member 39 is similarly constructed and retained in the sealing support 40, the roller 30 being pulled in the direction of the arrow C. The two sealing members 38, 39 and the two end plates 62, 63 of the sealing support 40 thereby complete a continuous sealing path which, together with the roller nip 36 retains the treatment liquid 24 in the vessel 13.

The end plates 62, 63 each include an aperture 74, the lower edge of which is positioned below the level of the top of the rollers 28, 30, enabling the bulk of the treatment liquid 24 to flow out of the vessel at each end thereof and to be recirculated as desired.

Figure 7:
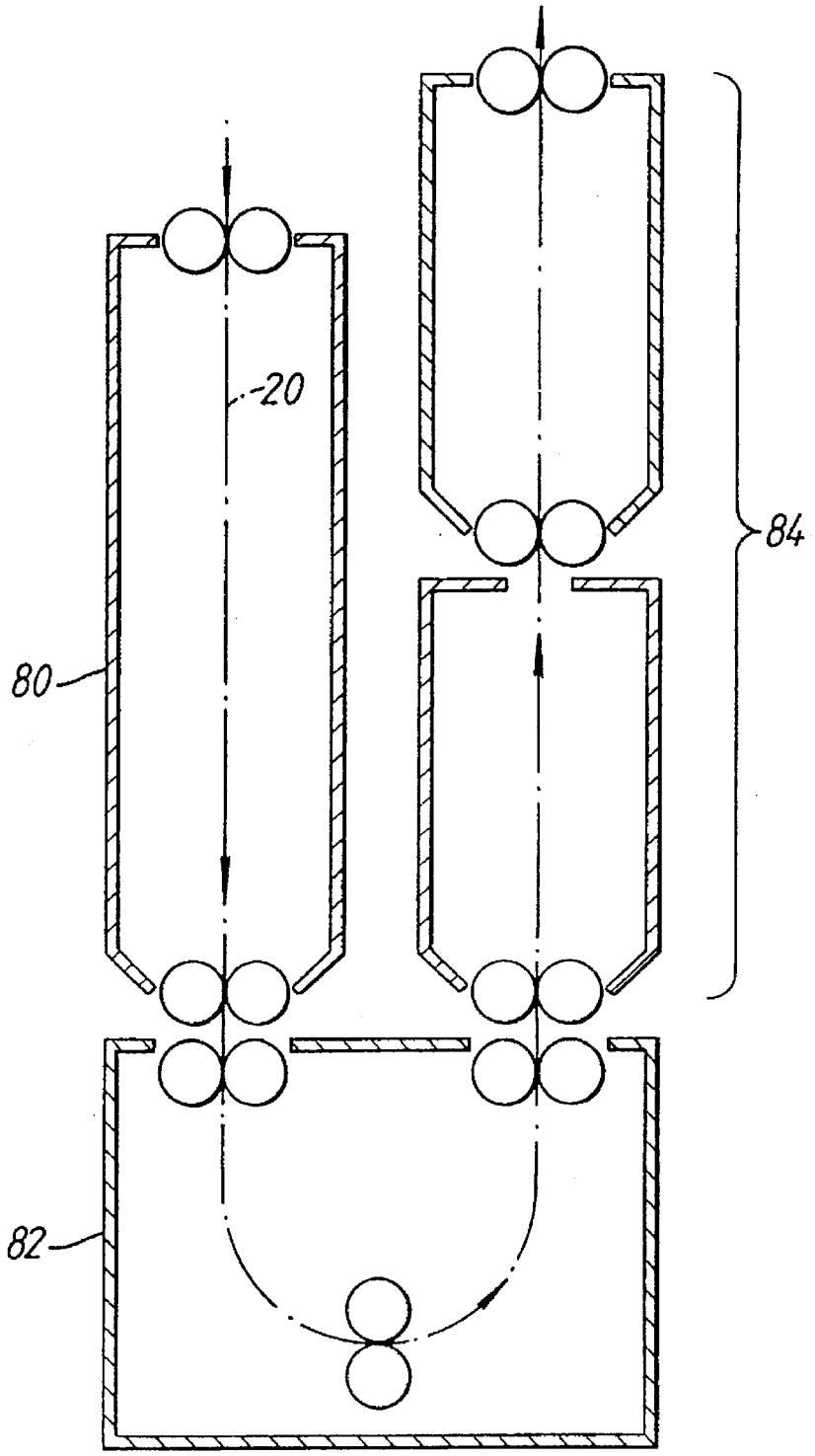
FIG. 7 shows schematically an arrangement for the processing of photographic sheet material, incorporating the vertical processing apparatus as shown in FIGS. 1 to 6.

The arrangement for the processing of photographic sheet material shown in FIG. 7 comprises a first vertical processing apparatus 80 constructed for example as shown in FIGS. 1 to 6, adapted for the development of images on the photographic sheet material. The first vertical processing apparatus 80 is coupled to a horizontal processing apparatus 82 adapted for the fixing of developed images on the photographic sheet material, in which the sheet material passes along a substantially horizontal path. The horizontal processing apparatus 82 is in turn coupled to a second vertical processing apparatus 84 also constructed for example as shown in FIGS. 1 to 6, but with the sheet material passing upwardly, the second vertical processing apparatus 84 being adapted for the cascade washing of the photographic sheet material.

As a consequence of the reduced evaporation of treatment liquids in an apparatus according to the invention, the regeneration of those liquids can proceed according to a more optimum regime. The total use of chemicals is thereby reduced, leading to environmental and cost-saving benefits.

In processing machines which are open to the atmosphere, such as a conventional horizontal machine, regeneration of the treatment liquids has to take account of (i) the loss of liquid from a given bath as a result of carry-over, (ii) loss of active ingredients as a result of consumption during processing and, for example, as a result of oxidation resulting from exposure to the atmosphere, and (iii) loss of water vapour as a result of evaporation. Evaporation is a significant, but generally unknown, factor in calculating the amount and frequency of addition of regeneration liquid. Evaporation is particularly an unknown factor because it depends on a number of external factors which may be variable and are not usually controlled, such as external temperature, humidity and ventilation.

In an apparatus according to the invention however, evaporation can be substantially reduced to a less significant level.

The regeneration calculation can therefore be reduced to factors which are either known or can be derived empirically.

In an example, the amounts of fresh developer regeneration solution which need to be added to maintain the active strength of a developer bath in a conventional prior art apparatus on the one hand and in an apparatus as shown in the drawing on the other hand, under typical conditions, have been found to be as follows.

| CONDITION | PRIOR ART APPARATUS | APPARATUS ACCORDING TO THE INVENTION |
|---|---|---|
| Shut down | 170 ml/day | 25 ml/day |
| Stand by | 400 ml/day | 50 ml/day |
| Operational | 400 ml/day + 150 ml/m$^2$ | 50 ml/day + 150 ml/m$^2$ |

The level of carry-over in the two apparatus was approximately the same at 17 ml/m$^2$ in the prior art apparatus and 15 ml/m$^2$ in the apparatus according to the invention, confirming that it is the reduced level of evaporation which is responsible for the lower amount of regeneration liquid which is required. Similarly advantageous results are obtained in respect of the amounts of fixer regeneration and washing water which are required by these apparatus.

The apparatus described herein can be used to process a number of different types of photographic sheet material, including for example X-ray film, one- and two-sheet DTR sheet materials, photolithographic plates and graphic arts sheet materials, the details of the apparatus being modified as desired according to the intended use.

For X-ray applications, processing conditions and the composition of processing solutions are dependent on the specific type of photographic material. For example, materials for X-ray diagnostic purposes may be adapted to rapid processing conditions. Preferably the processing apparatus is provided with a system for automatic regeneration of the processing solutions. The material may be processed using one-part package chemistry or three-part package chemistry, depending on the processing application determining the degree of hardening required in the processing cycle. Applications within total processing times of 30 seconds and higher up to 90 seconds, known as common practice, are possible. The processing may take place in a glutaraldehyde containing hydroquinone/1-phenyl-3-pyrazolidinone developer marketed by Agfa-Gevaert N. V. under the Trade Name G138 having a high activity or in a cheap developer with a low activity having the following composition amounts given in g/l.

| | |
|---|---|
| hydroquinone | 13.3 |
| phenidone | 0.8 |
| sodiummetabisulphite | 29.7 |
| ethylenediamine tetraacetic acid, tetrasodium salt trihydrate | 1.33 |
| potassium hydroxide | 27.9 |
| sodium tetraborate decahydrate | 8.8 |
| acetic acid | 5.2 |
| 5-methylbenzotriazole | 0.04 |
| 5-nitrobenzimidazole | 0.05 |
| glutaraldehyde | 3.0 |
| diethylene glycol | 12.8 |

Another suitable developer composition for X-ray sheets is the following:

Composition A

| | |
|---|---|
| potassium hydroxide composition (0.76 g/ml) | 74 ml |
| demineralised water | 100 ml |
| potassium sulphite solution (0.655 g/ml) | 390 ml |
| Trilon B (0.524 g/1) | 16 ml |
| Turpinol 2 NZ | 4 g |
| diethyleneglycol | 100 ml |
| potassium chloride | 3.2 g |
| potassium carbonate solution (0.765 g/ml) | 168 ml |

-continued

| | |
|---|---|
| hydroquinone | 120 g |
| Cobratec TT 100 | 0.36 g |
| demineralised water to | 1000 ml |

Composition B

| | |
|---|---|
| acetic acid 99% | 38 ml |
| phenidone | 6 g |
| 5 nitro-indazol | 1 g |
| polyethylen glycol 350 | 1 ml |
| diethylene glycol to | 100 ml |

Composition C

| | |
|---|---|
| glutaraldehyde | 76 ml |
| potassium metabisulphite | 36 g |
| demineralised water to | 100 ml |

Before use, 1 l of composition A is mixed with 2.8 l water, 100 ml composition B and 100 ml composition C.

Another suitable developer solution for X-ray sheets is the following:

Composition A

| | |
|---|---|
| ammonium thiosulphate solution (0.778 g/ml) | 880 ml |
| sodium sulphite (anhydrous) | 54 g |
| boric acid (sieved) | 25 g |
| sodium acetate 3 aq. | 70 g |
| acetic acid 96% | 40 ml |
| demineralised water to | 1000 ml |

Composition B

| | |
|---|---|
| demineralised water | 110 ml |
| acetic acid 96% | 40 ml |
| aluminium sulphate solution (0.340 g/l) | 100 ml |

Before use, 3.750 l water is mixed with 1 l composition A and 0.25 l composition B.

Photographic sheet materials designed for one sheet silver complex diffusion transfer reversal process (DTR process) may be developed with the aid of an aqueous alkaline solution in the presence of (a) developing agent(s) and (a) silver halide solvent(s).

Preferably the silver halide solvent is used in an amount between 0.01% by weight and 10% by weight and more preferably between 0.05% by weight and 8% by weight. Suitable silver halide solvents for use in connection with the present invention are e.g. 2-mercaptobenzoic acid, cyclic imides, oxazolidones and thiosulfates. Silver halide solvents that are preferably used are thiocyanates and alkanolamines.

Alkanolamines that are suitable for use in DTR processing may be of the tertiary, secondary or primary type. Examples of alkanolamines that may be used correspond to the following formula:

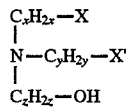

wherein X and X' independently represent hydrogen, a hydroxyl group or an amino group, x and y represent 0 or integers of 1 or more and z represents an integer of 1 or more. Preferably used alkanolamines are e.g. N-(2-aminoethyl)ethanolamine, diethanolamine, N-methylethanolamine, triethanolamine, N-ethyldiethanolamine, diisopropanolamine, ethanolamine, 4-aminobutanol, N,N-dimethylethanolamine, 3-aminopropanol, N,N-ethyl-2,2'-iminodiethanol, 2-aminoethyl-aminoethanol etc. or mixtures thereof.

The alkanolamines are preferably present in the alkaline processing liquid. However part or all of the alkanolamine can be present in one or more layers of the imaging element.

A further suitable type of silver halide solvents are thioether compounds. Preferably used thioethers correspond to the following general formula:

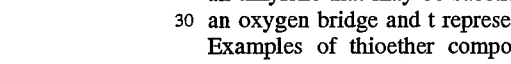

wherein Z and Y each independently represents hydrogen, an alkyl group, an amino group, an ammonium group, a hydroxyl, a sulfo group, a carboxyl, an aminocarbonyl or an aminosulfonyl, $R^1$, $R^2$ and $R^3$ each independently represents an alkylene that may be substituted and optionally contain an oxygen bridge and t represents an integer from 0 to 10. Examples of thioether compounds corresponding to the above formula are disclosed in e.g. U.S. Pat. No. 4,960,683 and European patent application EP-A-547662, which therefor are incorporated herein by reference.

Still further suitable silver halide solvents are meso-ionic compounds. Preferred meso-ionic compounds for use in connection with DTR processing are triazolium thiolates and more preferred 1,2,4-triazolium-3-thiolates.

At least part and most preferably all of the meso-ionic compound is present in the alkaline processing liquid used for developing the image-wise exposed imaging element. Preferably the amount of meso-ionic compound in the alkaline processing liquid is between 0.1 mmol/l and 25 mmol/l and more preferably between 0.5 mmol/l and 15 mmol/l and most preferably between 1 mmol/l and 8 mmol/l.

However the meso-ionic compound may be incorporated in one or more layers comprised on the support of the imaging element. The meso-ionic compound is in that case preferably contained in the imaging element in a total amount between 0.1 and 10 mmol/$m^2$, more preferably between 0.1 and 5 mmol/$m^2$ and most preferably between 0.5 and 1.5 mmol/$m^2$. More details are disclosed in European patent application EP-A-554585.

The alkaline processing liquid used preferably has a pH between 9 and 14 and more preferably between 10 and 13. Said pH may be established by an organic or inorganic alkaline substance or a combination thereof. Suitable inorganic alkaline substances are e.g. potassium or sodium hydroxide, carbonate, phosphate etc. Suitable organic alkaline substances are e.g. alkanolamines. In the latter case the alkanolamines will provide or help maintain the pH and serve as a silver halide complexing agent.

The alkaline processing liquid may also contain (a) developing agent(s). In this case the alkaline processing liquid is called a developer. On the other hand some or all of the developing agent(s) may be present in one or more layers of the photographic material or imaging element. When all of the developing agents are contained in the imaging element the alkaline processing liquid is called an activator or activating liquid.

Silver halide developing agents for use in accordance with the present invention are preferably of the p-dihydroxybenzene type, e.g. hydroquinone, methylhydroquinone or chlorohydroquinone, preferably in combination with an auxiliary developing agent being a 1-phenyl-3-pyrazolidone-type developing agent and/or p-monomethylaminophenol. Particularly useful auxiliary developing agents are the 1-phenyl-3-pyrazolidones. Even more preferred, particularly when they are incorporated into the photographic material are 1-phenyl-3-pyrazolidones of which the aqueous solubility is increased by a hydrophilic substituent such as e.g. hydroxy, amino, carboxylic acid group, sulphonic acid group etc. Examples of 1-phenyl-3-pyrazolidones substituted with one or more hydrophilic groups are e.g. 1-phenyl-4,4-dimethyl-2-hydroxy-3-pyrazolidone, 1-(4-carboxyphenyl)-4,4-dimethyl-3-pyrazolidone etc. However other developing agents can be used.

At least the auxiliary developing agents are preferably incorporated into the photographic material, preferably in the silver halide emulsion layer of the photographic material, in an amount of less than 150 mg/g of silver halide expressed as $AgNO_3$, more preferably in an amount of less than 100 mg/g of silver halide expressed as $AgNO_3$.

The alkaline processing liquid used for developing a DTR imaging element preferably also contains hydrophobizing agents for improving the hydrophobicity of the silver image obtained in the image receiving layer. The hydrophobizing agents used in connection with DTR processing are compounds that are capable of reacting with silver or silver ions and that are hydrophobic i.e. insoluble in water or only slightly soluble in water. Generally these compounds contain a mercapto group or thiolate group and one or more hydrophobic substituents e.g. an alkyl group containing at least 3 carbon atoms. Examples of hydrophobizing agents for use in DTR processing are e.g. those described in U.S. Pat No. 3,776,728, and U.S. Pat. No. 4,563,410. Preferred compounds correspond to one of the following formulae:

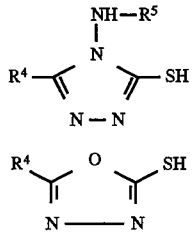

wherein $R^5$ represents hydrogen or an acyl group, $R^4$ represents alkyl, aryl or aralkyl. Most preferably used compounds are compounds according to one of the above formulas wherein $R^4$ represents an alkyl containing 3 to 16 C-atoms.

The hydrophobizing agents are contained in the alkaline processing liquid in an amount of at least 0.1 g/l, more preferably at least 0.2 g/1 and most preferably at least 0.3 g/1. The maximum amount of hydrophobizing agents will be determined by the type of hydrophobizing agent, type and amount of silver halide solvents etc. Typically the concentration of hydrophobizing agent is preferably not more than 1.5 g/l and more preferably not more than 1 g/l.

The alkaline processing liquid preferably also contains a preserving agent having antioxidation activity, e.g. sulphite ions provided e.g. by sodium or potassium sulphite. For example, the aqueous alkaline solution comprises sodium sulphite in an amount ranging from 0.15 to 1.0 mol/l. Further may be present a thickening agent, e.g. hydroxyethylcellulose and carboxymethylcellulose, fog inhibiting agents, e.g. potassium bromide, potassium iodide and a benzotriazole which is known to improve the printing endurance, calcium-sequestering compounds, anti-sludge agents, and hardeners including latent hardeners. It is furthermore preferred to use a spreading agent or surfactant in the alkaline processing liquid to assure equal spreading of the alkaline processing liquid over the surface of the photographic material. Such a surfactant should be stable at the pH of the alkaline processing liquid and should assure a fast overall wetting of the surface of the photographic material. A surfactant suitable for such purpose is e.g. a fluorine containing surfactant such as e.g. $C_7F_{15}COONH_4$. It is furthermore advantageous to add glycerine to the alkaline processing liquid so as to prevent crystallization of dissolved components of said alkaline processing liquid.

Development acceleration can be accomplished by addition of various compounds to the alkaline processing liquid and/or one or more layers of the photographic element, preferably polyalkylene derivatives having a molecular weight of at least 400 such as those described in e. g. U.S. Pat. No. 3,038,805, U.S. Pat. No. 4,038,075, U.S. Pat. No. 4,292,400 and U.S. Pat. No. 4,975,354.

Subsequent to the development in an alkaline processing liquid in accordance with the present invention the surface of the printing plate is preferably neutralized using a neutralization liquid.

A neutralization liquid generally has a pH between 5 and 8. The neutralization liquid preferably contains a buffer e.g. a phosphate buffer, a citrate buffer or mixture thereof. The neutralization solution can further contain bactericides, substances which influence the hydrophobic/hydrophilic balance of the printing plate obtained after processing of the DTR element, e.g. hydrophobizing agents as described above, silica and wetting agents, preferably compounds containing perfluorinated alkyl groups.

The two-sheet DTR process is by nature a wet process including development of the exposed silver halide in the emulsion layer of the photosensitive element, the complexing of residual undeveloped silver halide and the diffusion transfer of the silver complexes into the image-receiving material wherein physical development takes place.

The processing proceeds in alkaline aqueous medium. The developing agent or a mixture of developing agents can be incorporated into the alkaline processing solution and/or into the imaging material. When incorporated into the photosensitive element, the developing agent(s) can be present in the silver halide emulsion layer or is (are) preferably present in a hydrophilic colloid layer in water-permeable relationship therewith, e.g. in the anti-halation layer adjacent to the silver halide emulsion layer of the photosensitive element. In case the developing agent or a mixture of developing agents is in its total contained in the photosensitive element, the processing solution is merely an aqueous alkaline solution that initiates and activates the development.

Suitable developing agents for the exposed silver halide are e.g. hydroquinone-type and 1-phenyl-3-pyrazolidone-type developing agents as well as p-monomethylaminophenol. Preferably used is a combination of a hydroquinone-type and 1-phenyl-3-pyrazolidone-type developing agent whereby the latter is preferably incorporated in one of the layers comprised on the support of the imaging material. A preferred class of 1-phenyl-3-pyrazolidone-type developing agents is disclosed in European patent application EP-A-498968.

The silver halide solvent, preferably sodium or ammonium thiosulphate, may be supplied from the non-light-sensitive image-receiving element as mentioned above, but it is normally at least partly already present in the alkaline processing solution. When present in the alkaline processing solution, the amount of silver halide solvent is in the range of e.g. 10 g/l to 50 g/l.

Preferred alkaline substances are inorganic alkali e.g. sodium hydroxide, sodium or potassium carbonate, sodium phosphate, sodium borate or alkanolamines or mixtures thereof. Preferably used alkanolamines are tertiary alkanolamines e.g. those described in European patent applications EP-A 397925, 397926, 397927 and 398435 and U.S. Pat. No. 4,632,896. A combination of alkanolamines having both a $pK_a$ above or below 9 or a combination of alkanolamines whereof at least one has a $pK_a$ above 9 and another having a $pK_a$ of 9 or less may also be used as disclosed in the Japanese patent applications laid open to the public numbers 73949/61, 73953/61, 169841/61, 212670/60, 73950/61, 73952/61, 102644/61, 226647/63, 229453/63, U.S. Pat. Nos. 4,362,811 and 4,568,634. The concentration of these alkanolamines is preferably from 0.1 mol/l to 0.9 mol/l.

The alkaline processing solution usually contains preserving agents e.g. sodium sulphite, thickening agents e.g. hydroxyethylcellulose and carboxymethylcellulose, fog-inhibiting agents such as potassium bromide, black-toning agents especially heterocyclic mercapto compounds, detergents e.g. acetylenic detergents such as SURFYNOL 104, SURFYNOL 465, SURFYNOL 440 etc. all available from Air Reduction Chemical Company, N.Y., USA.

The DTR-process is normally carried out at a temperature in the range of 10° C. to 35° C.

The pH of the processing solution is preferably in the range of 9 to 14, more preferably in the range of 10 to 13.

Photolithographic plates may be processed by compositions with an aqueous alkaline developer comprising at least one basic substance such as potassium hydroxide or sodium silicate, and one neutral salt such as sodium or potassium chloride. Examples of such developers include:

Composition A

| | |
|---|---|
| sodium metasilicate $5H_2O$ | 30 g |
| Aerosol OS (Trade Mark) | 2.16 g |
| sodium chloride | 30 g |
| Water to | 1000 ml |

Composition B

| | |
|---|---|
| sodium metasilicate $5H_2O$ | 4.0% |
| trisodium phosphate $12H_2O$ | 3.4% |
| monosodium phosphate | 0.3% |
| sodium hydroxide (reagent grade) | 0.7% |
| soft water | 1000 ml |

For the processing of graphic arts sheet materials, developers typically contain hydroquinone, together with alkali metal (sodium or potassium) carbonates, sulphites and bromides. These compositions are used at a pH level of typically from 10.5 to 13.5.

We claim:

1. An apparatus for the processing of photographic sheet material comprising:

a plurality of cells (12, 12', 12") of modular construction mounted one above the other in a stack to define a substantially vertical sheet material path (20) through the apparatus, each cell comprising a housing within which is mounted a rotatable roller (28) biased towards a reaction surface (31) to define a roller nip (36) therebetween through which said sheet material path extends and associated sealing means (38, 39) serving to provide a gas- and liquid-tight seal between said roller and reaction surface on the one hand and a housing wall (14) on the other, the housing wall (14) of each cell (12, 12', 12") comprising an upper housing wall part (15) having an upper flange (19) and a lower housing wall part (16) having a lower flange (21), the upper housing wall part being so shaped in relation to the lower housing wall part of the next higher cell as to provide a substantially closed connection between adjacent cells, and means (23) for securing the upper flange (19) with the lower flange (21) of the next higher cell to provide the substantially closed connection.

2. The apparatus of claim 1, wherein the roller (28), reaction surface (31) and sealing means (38, 39) of the top-most cell (12') of the stack serve to provide a gas-tight cover for the apparatus.

3. The apparatus of claim 1, wherein at least one cell (12) of the stack is in the form of a vessel (13), the roller (28), reaction surface (31) and sealing means (38, 39) serving to retain treatment liquid (24) in the vessel.

4. The apparatus of claim 3, wherein the housing wall (14) has at least one passage (26) there-through to constitute a treatment liquid inlet to and/or outlet from the vessel.

5. The apparatus of claim 3, wherein the lower housing wall part (16) is shaped to define a leakage tray (42) positioned so that any treatment liquid which passes through the nip (36) drips into the leakage tray.

6. The apparatus of claim 1, wherein the flanges are formed by a common housing wall of the apparatus.

7. The apparatus of claim 1, wherein the housing of each of the cells further comprises a seam along a substantially vertical plane, enabling the apparatus to be opened-up for servicing purposes.

8. The apparatus of claim 1, wherein the roller (28) is a drive roller.

9. The apparatus of claim 8, wherein the reaction surface (31) is constituted by the surface of a second roller (30), thereby to constitute a driven roller pair.

10. The apparatus of claim 9, wherein at least one of the cells is free of any roller pairs.

11. The apparatus of claim 8, wherein one or more of the cells includes additional features selected from cleaning means, additional rollers, sheet material guide means, sheet material drying means, and any combination thereof.

12. An arrangement for the processing of photographic sheet material, comprising a first vertical processing apparatus according to claim 1 coupled to a horizontal processing apparatus in which the sheet material passes along a substantially horizontal path.

13. The arrangement of claim 12, wherein the horizontal apparatus is coupled to a second vertical processing apparatus according to claim 1.

14. The arrangement of claim 13, wherein the first vertical processing apparatus is adapted for the development of images on the photographic sheet material, the horizontal processing apparatus is adapted for the fixing of developed images on the photographic sheet material and the second vertical processing apparatus is adapted for the cascade washing of the photographic sheet material.

* * * * *